US006446824B1

(12) United States Patent
Sluiter

(10) Patent No.: US 6,446,824 B1
(45) **Date of Patent: *Sep. 10, 2002**

(54) LOADING UNIT FOR AIR FREIGHT

(75) Inventor: Pieter Egbert Sluiter, Wormerveer (NL)

(73) Assignee: KLM Royal Dutch Airlines, Amsterdam (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/367,226

(22) PCT Filed: Feb. 12, 1998

(86) PCT No.: PCT/NL98/00091

§ 371 (c)(1),
(2), (4) Date: Nov. 2, 1999

(87) PCT Pub. No.: WO98/35890

PCT Pub. Date: Aug. 20, 1998

(30) Foreign Application Priority Data

Feb. 12, 1997 (NL) ..... 1005258

(51) Int. Cl.[7] ..... B65D 6/16

(52) U.S. Cl. ..... 220/6; 220/4.28; 220/4.29; 220/4.31

(58) Field of Search ..... 220/6, 4.28, 4.29, 220/4.31; 217/12 R, 14, 15, 16, 43 R, 45, 46, 48

(56) References Cited

U.S. PATENT DOCUMENTS

| | | | | | |
|---|---|---|---|---|---|
| 616,146 | A | * | 12/1898 | Runkle | 217/16 |
| 1,039,452 | A | * | 9/1912 | Shepard | 217/13 |
| 2,869,750 | A | * | 1/1959 | Doerr et al. | 220/4.28 |
| 3,266,656 | A | | 8/1966 | Kridle | |
| 3,374,915 | A | * | 3/1968 | Verhein et al. | 220/4.28 |
| 3,401,814 | A | | 9/1968 | Chiswell et al. | |
| 3,423,101 | A | | 1/1969 | Boeye | |
| 3,809,278 | A | * | 5/1974 | Csumrik | 217/13 X |
| 3,940,007 | A | * | 2/1976 | Griffiths | 220/4.28 |
| 4,069,938 | A | * | 1/1978 | Palte et al. | 217/16 X |
| 4,411,373 | A | | 10/1983 | Kupersmit | |
| 4,828,132 | A | * | 5/1989 | Francis, Jr. et al. | 220/6 |
| 4,860,912 | A | | 8/1989 | Kupersmit | |
| 5,558,241 | A | * | 9/1996 | Huffstutler, Jr. et al. | 220/4.31 |

FOREIGN PATENT DOCUMENTS

| | | | | |
|---|---|---|---|---|
| AU | 20682 | * | 1/1936 | 217/46 |
| EP | 0 415 262 | | 10/1993 | |
| EP | 581271 | * | 2/1994 | 217/13 |
| GB | 859965 | * | 1/1961 | 217/16 |
| GB | 2166116 | * | 4/1986 | 220/4.31 |

* cited by examiner

*Primary Examiner*—Lee Young
*Assistant Examiner*—Joseph C. Merek
(74) *Attorney, Agent, or Firm*—Young & Thompson

(57) ABSTRACT

A loading unit for air freight comprises a loading base (1), four upright walls (3, 4, 5, 25, 26) on the loading base (1) and a cover (2) on the upright walls, the walls being detachably joined to the loading base (1) and the cover (2). The loading base (1) and the cover (2) have slots (11) on their periphery in which the walls can be accommodated. The loading base (1) and the cover (2) also have upright edges (9, 10, 14, 15) which can be placed directly one on top of the other.

8 Claims, 6 Drawing Sheets

LOADING UNIT FOR AIR FREIGHT

The invention relates to the field of air freight, in particular to the freight units to be used in this sector. Goods for air freight are usually tendered as individual packages. On the other hand, it is necessary to pack the freight together to form larger units, which it must be possible to handle efficiently using fork lift trucks and the like.

Pallets which provide room for a number of freight packages are already used in this context. The freight packages are stacked on the pallet as regularly as possible, after which the stack is covered by a net which is attached firmly to the edges of the pallet.

Although the use of these pallets already results in a certain gain in loading time and ease of use, there are nevertheless still various disadvantages associated with this. For instance, it is not readily possible, for example, to stack two laden pallets on top of one another. Furthermore, the freight packages are not well or adequately protected against the effects of weather, which is a disadvantage when loading or unloading an aircraft in the open air.

Up to now, however, this method of loading has been accepted, if only because the weight of the loading aids, such as pallet and net, is not too high. Furthermore, the unloaded loading aids must not take up an unnecessarily large amount of space for transport. However, the abovementioned problems, such as the lack of stackability, are becoming increasingly pressing.

The aim of the invention is, therefore, to provide a better and more efficient aid for air freight which, on the one hand, offers better protection for the air freight packages and which, on the other hand, does not weigh too much or take up too much space. To this end the invention relates to a loading unit for air freight, comprising a loading base, upright walls on the loading base and a flat cover on the upright walls, which walls are detachably joined to the loading base and the cover and at least two walls being joined to one another to form at least one self-supporting wall unit.

The detachable walls have the advantage that the empty loading unit can be transported as a small pack. To this end the loading base preferably has slots, in which the walls can be accommodated, around at least part of its periphery. The cover also has slots, in which the walls can be accommodated, around at least part of its periphery.

The loading base and/or the cover have upright edges which can be placed directly one on top of the other. The edges are of a height such that the detached walls can be accommodated between base and cover positioned one on top of the other.

The walls can be joined to one another to ensure good coherence of the walls and thus a sufficiently high strength of the loading unit on stacking. These joins provide a self-supporting wall unit, which wall unit can comprise all four walls. Such a wall unit has adequate load bearing capacity to be able to support a further stacked loading unit without corner columns being required for this purpose. The advantage of the loading unit according to the invention is therefore that the number of component parts remains limited. A block-shaped or cube-shaped loading unit can consist of a maximum of six separate parts, that is to say the loading base, the cover and at most four separate walls. The four walls can, however, form an integral unit, as a result of which there would be only three separate parts.

The consequence of this is that the loading unit can be assembled or dismantled quickly and easily. The possibility of parts becoming lost is also virtually precluded. After all, the loading unit has no (relatively small) fixings and consequently is immediately ready for assembly.

To reduce the size of the loading unit when it is transported empty, two opposing walls can be divided over their height into two wall sections which can be turned relative to one another, which walls can be folded up after they have been removed from the loading base and cover, such that the wall sections come to lie between, under or on the other two walls.

By virtue of the two foldable walls divided into wall sections, the whole can be folded up into a fairly small pack which fits easily between the loading base and cover placed one on top of the other.

The walls can be made of a wide variety of materials which have the requisite mechanical properties; thus, for example, cardboard can be used. In addition, walls can be joined two by two and closed all round to form a self-supporting wall unit closed on all sides.

Cardboard, in particular corrugated cardboard of the appropriate thickness, offers the advantage of a low weight in combination with excellent strength, including the ability to withstand stacking forces. Moreover, the cardboard can have been treated such that it can be exposed to fluctuating weather effects without any problems.

An embodiment in which each wall has integral joining parts on its upright edges, by means of which integral joining parts the walls are joined together two by two, is also possible.

The walls can all be dismantled into separate parts. On the other hand, they can be joined to one another firmly in such a way that one or more self-supporting units are formed which provide a non-buckling support. The walls themselves are exposed to compressive forces over their entire cross-section as a result of which firm support is ensured. The non-buckling stability of the walls can be appreciable by virtue of the distributed load.

Each integral joining part can be a shaped section permanently fixed at the edge of a wall. The joining parts can, for example, have hook elements, which hook elements can be slid into one another in the direction of the edges of the walls.

The transverse dimensions of said shaped section components can be very small since these components have to play no part in supporting any loading unit stacked on top.

Each shaped section can have an undercut cavity into which a hook component of an adjacent shaped section can be slid.

Furthermore one shaped section of each two shaped sections joined to one another can be constructed with an undercut cavity at the end of the associated wall and the other shaped section with an undercut cavity at the face of the other associated wall, which face faces the end of the first wall.

In the case of relatively high loading units, the walls can be subdivided in the height direction into wall sections located above one another and every two of said wall sections located above one another can be linked by an H-shaped section. The advantage of this embodiment is that the walls can be reduced to one or more small packs, which once again can be accommodated between the loading base and cover placed one on top of the other.

The loading base can have support on its underside, between which supports the forks of a fork lift truck can be accommodated.

To guarantee interchangeability with the known pallets in use to date, the loading unit according to the invention has a loading base which has external dimensions of 1.02×1.22 m. Because cardboard walls are used, the internal dimensions can be 1.00×1.20 m. The total external height of the loading unit, including supports, can be 0.75 or 1.50 m. When folded up, the loading unit can have a height of 1/7 of the total 1.50 m.

An illustrative embodiment of the loading unit according to the invention will now be explained in more detail with reference to the drawings.

Figure 4A:
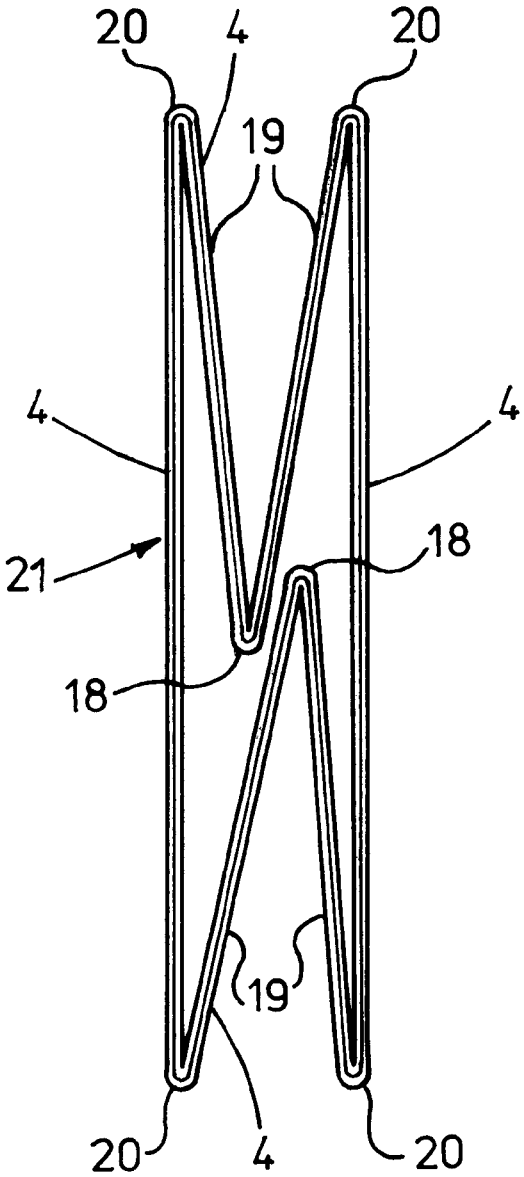

FIGS. 4*a, b* show a cross-section of a wall.

Figure 5:
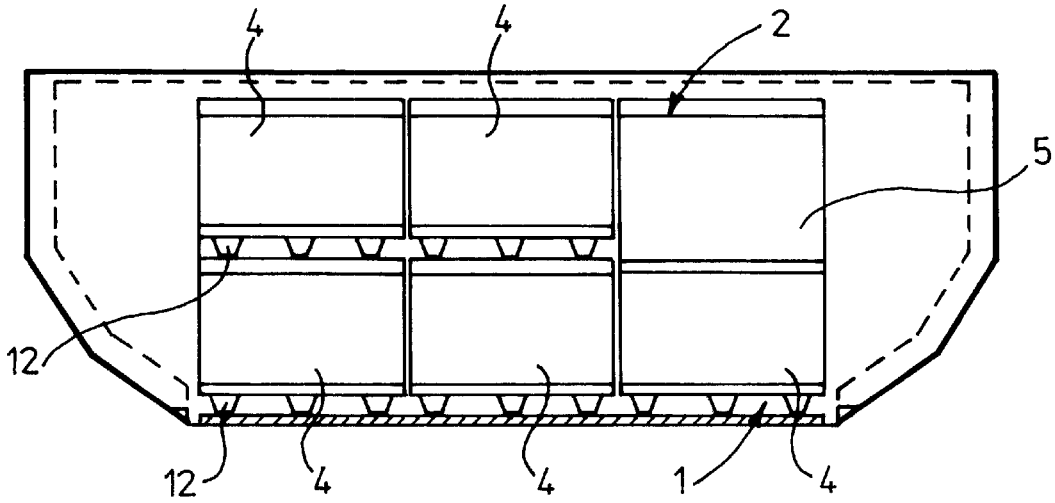

FIG. 5 shows an example of the use of various loading units in the cargo hold beneath the deck of an aircraft.

Figure 6:
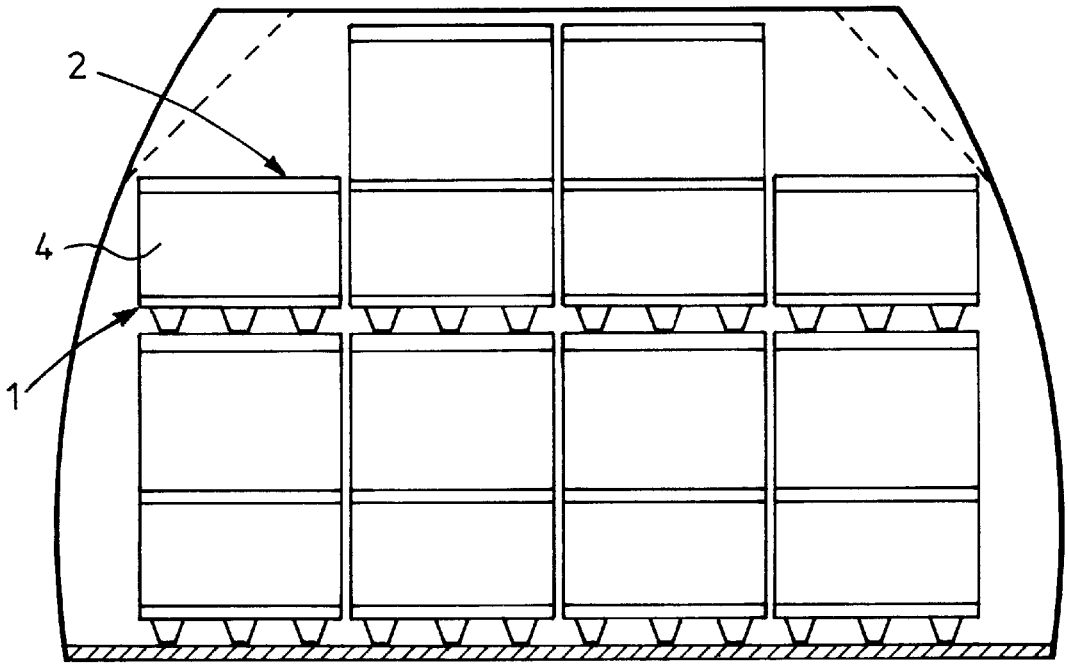

FIG. 6 shows an example of the use of various loading units according to the invention in the cargo area above the deck of an aircraft.

Figure 7:
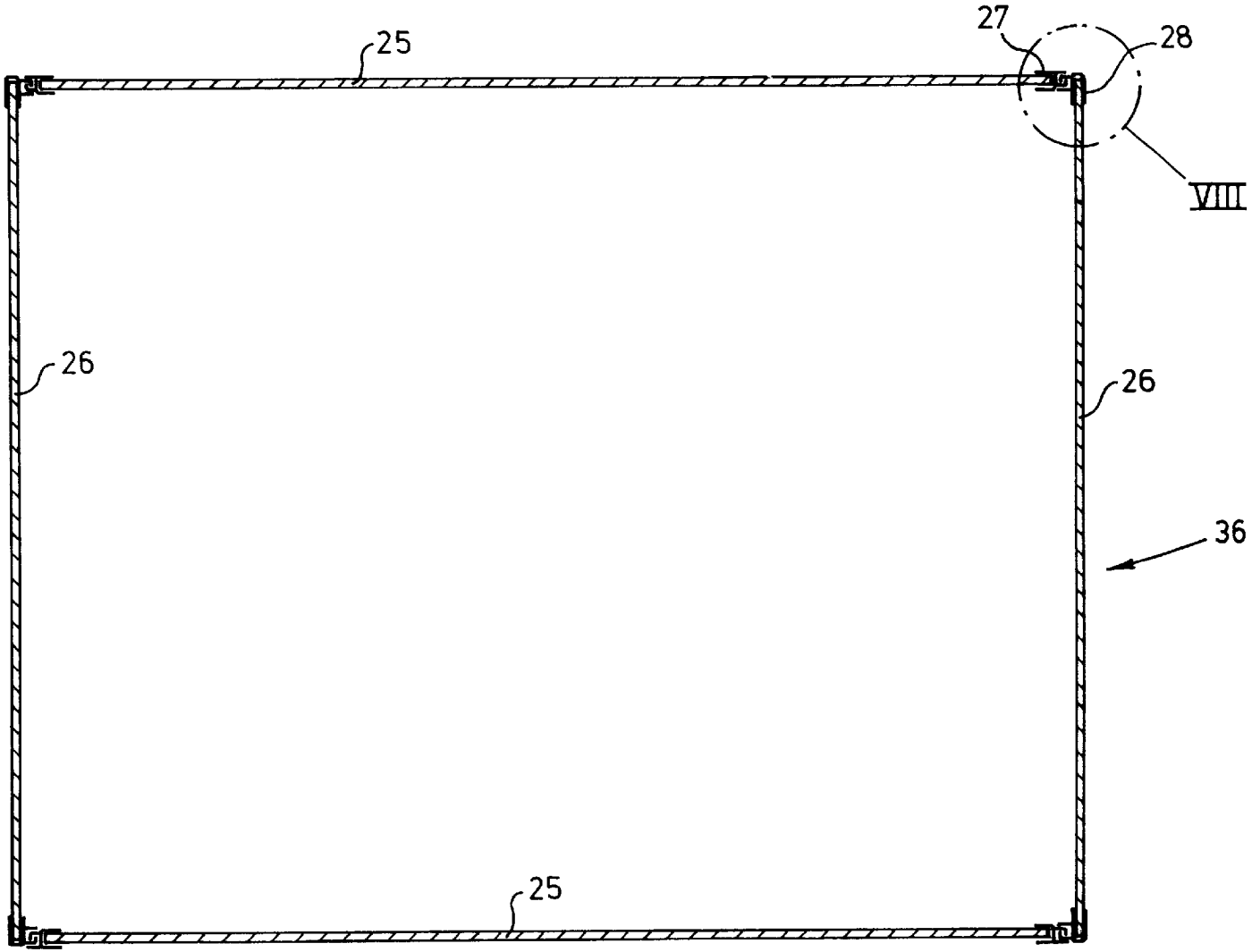

FIG. 7 shows a cross-section through the walls of a further embodiment of the loading unit.

Figure 8:
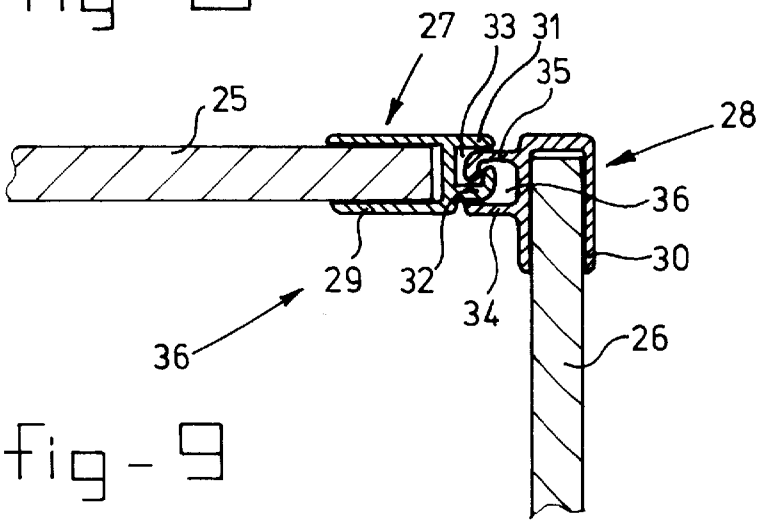

FIG. 8 shows detail VIII from FIG. 7.

Figure 9:
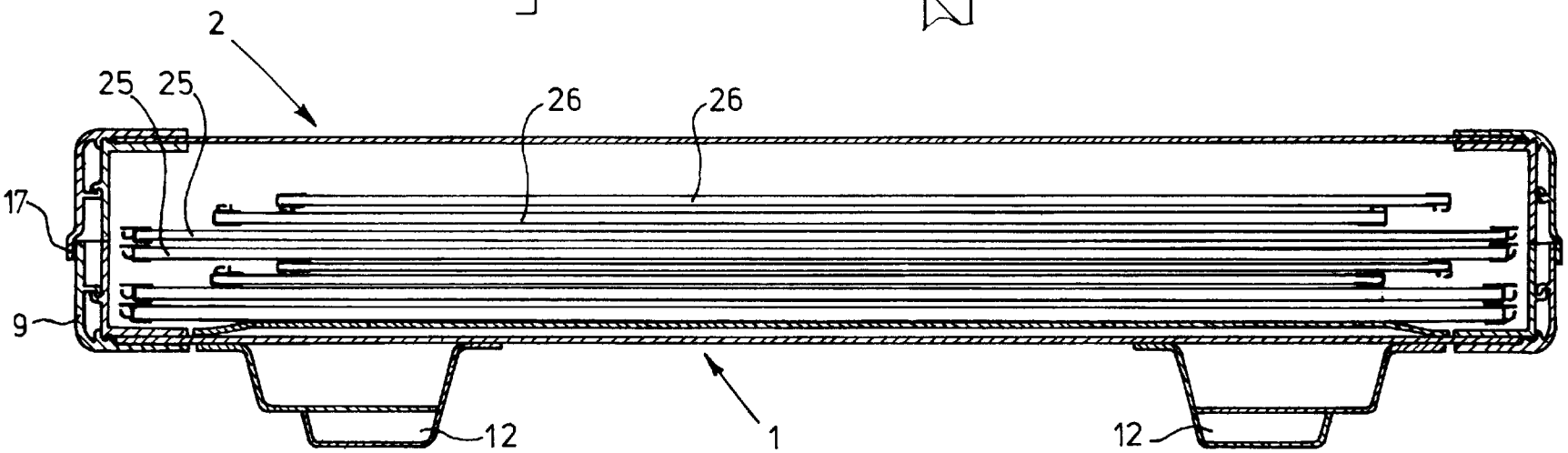

FIG. 9 shows the loading unit according to FIGS. 7 and 8 in the form in which it has been reduced to a pack.

Figure 1:
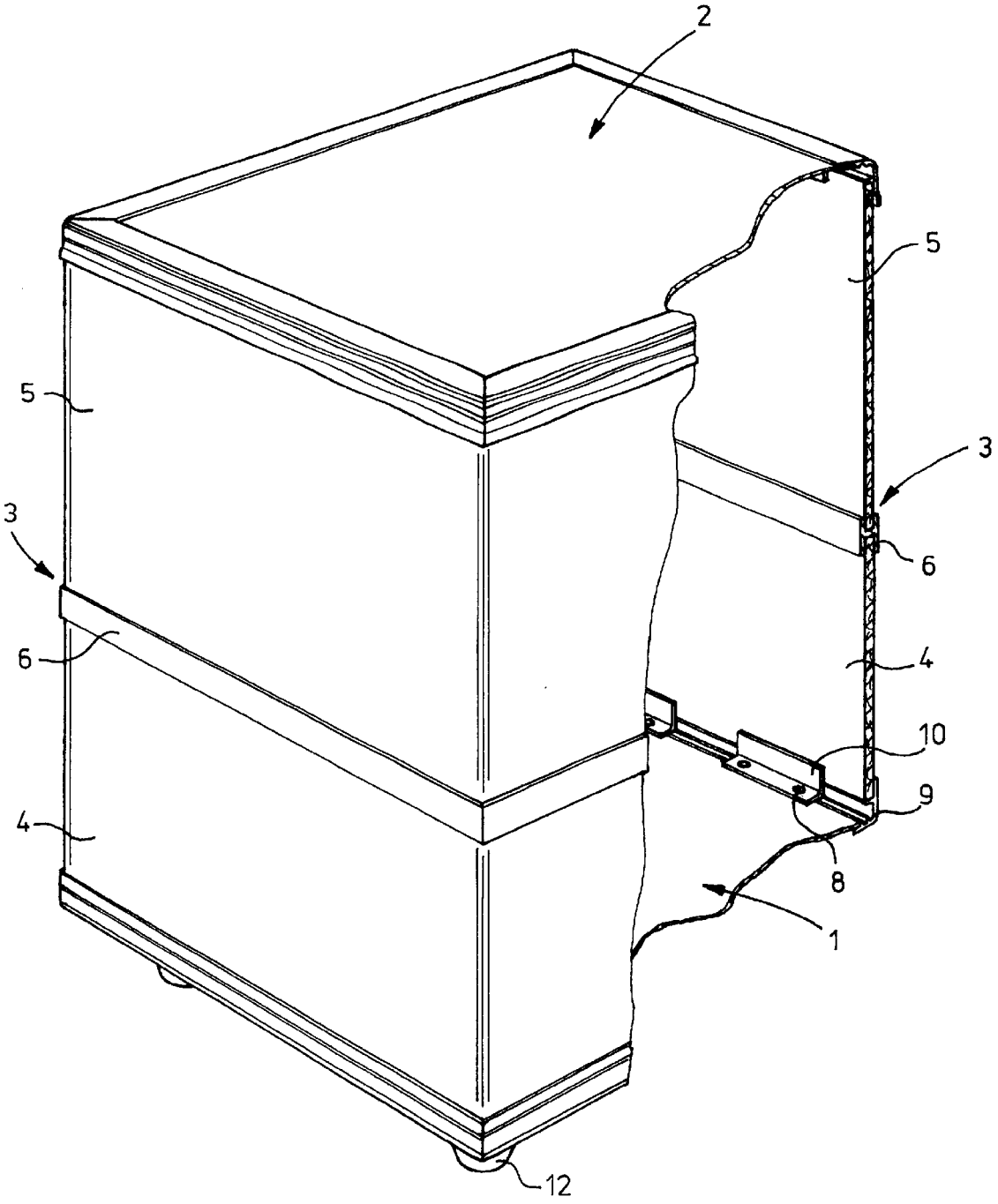
FIG. 1 shows a perspective and partially exposed view of a loading unit according to the invention.

The loading unit shown in FIG. 1 has a loading base 1, a cover 2 and four walls, which are indicated in their entirety by 3.

Each wall consists of a lower wall section 4 and an upper wall section 5, linked together by an H-shaped section 6.

Figure 2:
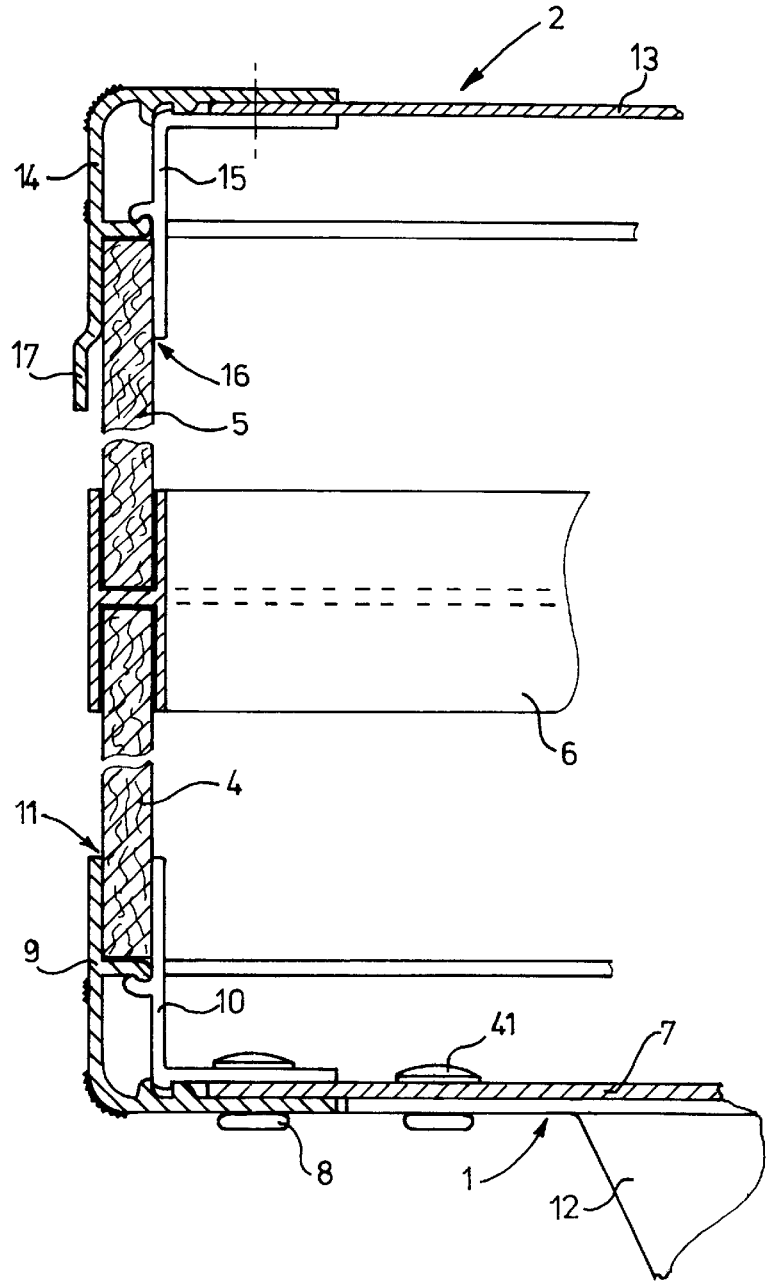
FIG. 2 shows a vertical cross-section through the loading unit.

As can be seen more clearly in FIG. 2, the loading base 1 consists of a baseplate 7, which is provided, by means of rivets 8, with shaped sections 9, 10 which form upright edges. The ends of the upright shaped sections 9, 10 form peripheral slots 11, in which the respective wall sections 4 can be accommodated.

In addition, supports 12 are fixed to the loading base 1 by means of rivets 41.

Correspondingly, the cover consists of a cover plate 13, which is provided at the edges with edge shaped sections 14, 15 which form the upright edge of the cover. At their ends, said edge shaped sections 14, 15 form a slot 16, in which the respective wall sections 5 are accommodated.

Figure 3:
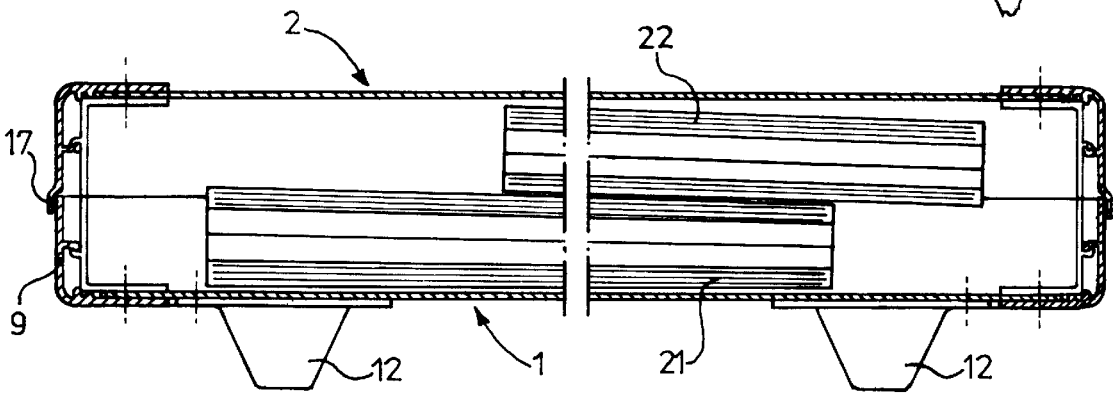
FIG. 3 shows the loading unit in the form in which it is reduced to a pack.

The edge shaped section 14 has an end region 17 which is extended outwards and, as can be seen in FIG. 3, engages over the edge shaped section 9 of the loading base 1 when the cover 2 is placed directly on the loading base 1.

After they have been removed from the slots 11, 16 and from the H-section 6, the wall sections 4 and 5, respectively, can be folded up in the manner shown in FIG. 4*a*. Two of the opposing wall sections 4, 5 can be divided by means of a fold line 18 into two wall sections 19 such that they can be folded to form a small pack. To this end the wall sections 19 are joined via fold lines 20 with the other two wall sections 4, 5.

In the cross-section shown in FIG. 3 it can be seen that the packs 21 (comprising wall sections 4) and 22 (comprising wall sections 5) can be accommodated within loading base and cover.

Preferably, the wall sections 4 are lower than the wall sections 5. The advantage of this will be explained with reference to the use shown in FIG. 5. The loading unit according to the invention can be placed at its maximum height in the cargo hold beneath the floor of an aircraft. As an alternative, smaller loading units, each with wall sections 4, can be placed one on top of the other two by two. By virtue of the fact that the wall sections 4 are somewhat lower than the wall sections 5, a stack of two smaller loading units will still fit within said hold, despite the fact that there is an extra set of supports 12 for the upper loading unit.

A further example of use is shown in FIG. 6, where part of the space above the deck of an aircraft is now utilised as cargo area. The loading units with wall sections 4 are likewise used in this illustrative embodiment, in this case in the vicinity of the lower parts of the cargo area. If the height of the cargo area at the sides permits, it is, of course, possible to use a loading unit which has the higher wall sections 5 in this location as well.

Figure 4B:
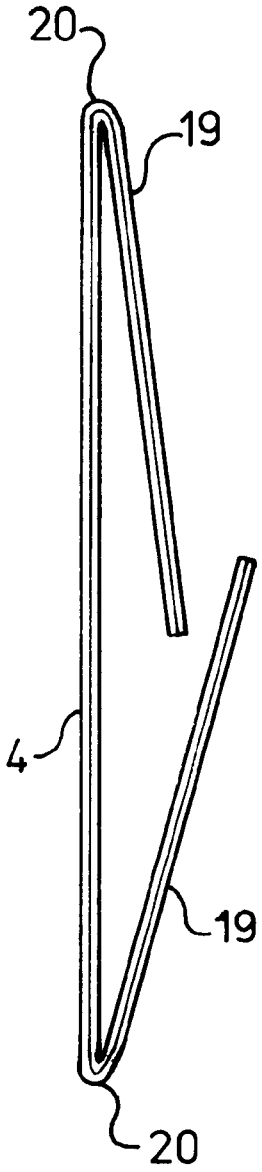

As a variation from the embodiment shown in FIG. 4, the wall sections 4, 5 can be separated at the fold line 18 which is shown in FIG. 4. In this way walls 4, 5 are obtained which each consist of two separate halves, each consisting of a complete wall section 4 or 5, with a half wall section 4 or 5 on either side (see FIG. 4*b*). Together these halves again form a complete rectangle or square.

The horizontal cross-section shown in FIG. 7 shows the walls 25, 26 of the loading unit. Said walls 25, 26 are detachably joined to one another by the respective shaped sections 27, 28 at the two vertical edges of the walls 25, 26.

The shaped sections 27 and 28 do not have a supporting function, that is to say they play no role in transmitting vertical loads, for example as produced by a stacked loading unit.

The reason for this is that the cross-sectional dimensions of the shaped sections 27, 28 are so small that such a load is transmitted mainly by the walls 25, 26 themselves.

As shown in FIG. 8, the shaped sections 27, 28 each consist of a U-shaped section 29, 30 in which the side edge of the associated walls 25, 26 is permanently fixed. Said permanent fixing can be provided, for example, by means of rivets, gluing, welding and the like.

The shaped section 27 has a flange 31 and a hook 32, which together form an undercut cavity 33.

Shaped section 28 likewise has a flange 34 and hook 35, which define the undercut cavity 36.

The walls 25, 26 can be joined to one another by sliding each of the hooks 32, 35 into the undercut cavity 33, 36 of the other shaped section, in the longitudinal direction of said shaped sections.

In the position in which they have been slid into one another, the shaped sections 27, 28 provide a firm fixing between the two walls 25, 26.

There are corresponding shaped sections at the other corners.

As shown in FIG. 9, when stacked on top of one another the walls 25, 26 can be accommodated within the loading base 1 and the cover 2. In the example shown in FIG. 9, a total of four walls 25 and four walls 26 are accommodated, sufficient to form a relatively high loading unit with walls divided in the height direction, analogous to the embodiment in FIG. 1.

What is claimed is:

1. A loading unit for air freight, comprising:

a loading base;

upright walls on said loading base; and a flat cover on said upright walls, said walls being detachably joined to said loading base and said cover and being joined to one another to form a self-supporting wall unit, said loading base and said cover, around at least part of their periphery, having slots in which each of said walls can be accommodated, each of said walls having integral joining parts on respective upright edges, said joining parts including a shaped section permanently fixed at said upright edges of said walls, said shaped sections joining said walls together two by two, said shaped sections each having a hook element and a flange forming an undercut cavity into which said hook element of an adjacent shaped section can be slid, said hook element of a first shaped section extends from an edge surface of one of said walls, parallel to said one of said walls, and said undercut cavity of a second shaped section being defined by said hook element and said flange of said second shaped section that extend perpendicularly from a face of another of said walls, said face facing said edge surface of said one of said walls.

2. Loading unit according to claim 1, wherein loading base (1) and cover (2) have upright edges (9, 10; 14, 15) which are located directly opposite one another, such that said edges can be placed one on top of the other after removing said walls.

3. Loading unit according to claim 2, wherein the edges (9, 10; 14, 15) have a height such that the detached walls (3, 4, 5) can be accommodated between loading base (1) and cover (2) placed one on top of the other.

4. The loading unit according to claim 1, wherein the walls are made of cardboard.

5. Loading unit according to claim 1, wherein the loading base (1) has supports (12) on its underside, between which supports the forks of a fork lift truck can be accommodated.

6. Loading unit according to claim 1, wherein the external dimensions of the loading base are 1.02×1.22 m.

7. Loading unit according to claim 1, wherein the total height including supports (12) is 1.50 m.

8. Loading unit according to claim 1, wherein the total height including supports (12) is 0.75 m.

* * * * *